United States Patent [19]

May

[11] 4,021,939

[45] May 10, 1977

[54] MOVIE-CUBES

[76] Inventor: Robert Joseph May, 92 Grove St., Apartment 38, New York, N.Y. 10014

[22] Filed: Oct. 3, 1975

[21] Appl. No.: 619,216

[52] U.S. Cl. ..... 35/69; 46/17; 273/157 R

[51] Int. Cl.[2] ..... A63H 33/04

[58] Field of Search ..... 35/27, 28, 69; 273/157 R, 157 A

[56] References Cited

UNITED STATES PATENTS

| | | | |
|---|---|---|---|
| 176,532 | 4/1876 | Hughes | 273/157 R |
| 717,105 | 12/1902 | Mansfield | 273/157 R UX |
| 1,676,641 | 7/1928 | Eschenbach | 273/157 R |
| 1,809,378 | 6/1931 | Eschenbach | 35/69 UX |
| 3,464,145 | 9/1969 | Martin | 273/157 R X |

FOREIGN PATENTS OR APPLICATIONS

| | | | |
|---|---|---|---|
| 967,675 | 3/1950 | France | 273/157 |

*Primary Examiner*—Harland S. Skogquist

[57] ABSTRACT

Movie-Cubes is a system by which all the surfaces of a group of three-dimensional cubes are patterned in a way that when the cubes are arranged and moved correctly, they create a continuous picture or pattern that changes and eventually returns to itself. The pattern is laid out on a 45° zig-zag graph before it is applied to the cubes. When this group of patterned cubes is arranged, so that the picture or pattern matches from cube to cube, and alternating rows of matched cubes are moved correctly, they create a picture or pattern that not only changes, but eventually returns to where it started. This system operates on the principle of geometric progression whereby, once the group of cubes is matched correctly, they are moved and rotated in alternating rows from one side of the group of cubes to the opposite side. With each rotation and movement of a row of matched cubes, a new part of the picture or pattern is exposed until the picture or pattern eventually returns to its starting point.

8 Claims, 12 Drawing Figures

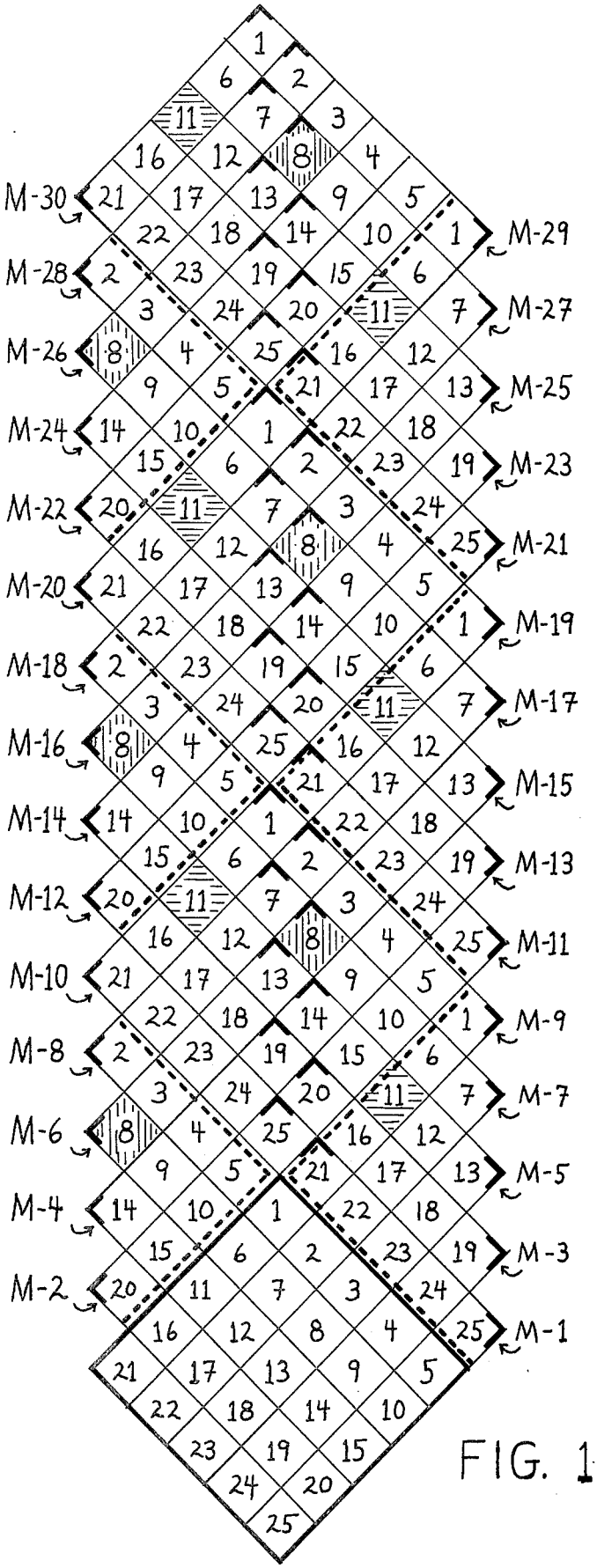
FIG. 11
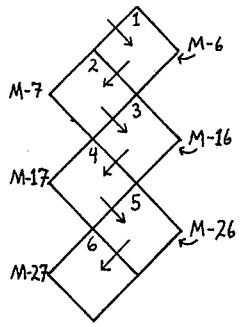
FIG. 12
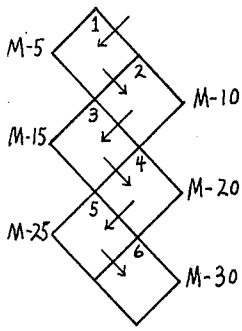

MOVIE-CUBES

My invention, Movie-Cubes, is described in the following example of a picture puzzle, which I constructed, that is made up of a group of 25 patterned cubes in a specially designed box. The group of cubes can be scattered on the floor, put back together by matching the picture or pattern on the surfaces of the cubes, and moved within the box to reveal an evolving picture. In order to understand the complexity and mechanics of the Movie-Cube system, we must first focus on all the aspects of the more easily understood puzzle, and from there build to an understanding of the geometric progression within the Movie-Cube system itself.

FIGS. 10 and 11 illustrate two -dimensionally a complete pattern layout for the cubes; and FIG. 12 represents the shape of six surfaces of two of the cubes from FIG. 11.

Figure 1:
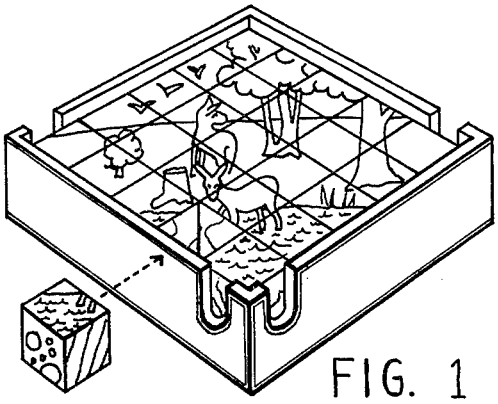
FIG. 1 shows patterned cubes in a box.

The puzzle consists of 25 patterned cubes and a square shallow box in which the 25 patterned cubes can be moved, FIG. 1. FIG. 1 also shows one of the patterned cubes out of the box. The surface of each cube is painted in a way that when the cubes are arranged correctly in the box, so that the picture or pattern matches from cube to cube, they form a 25 cube picture puzzle. When the cubes are moved correctly, within the box, the picture or pattern changes. Two rows of cubes are moved and rotated alternately from one side of the box to the opposite side, and and when this balanced sequence of moves continues, the picture oe pattern eventually returns to where it started.

Figure 2:
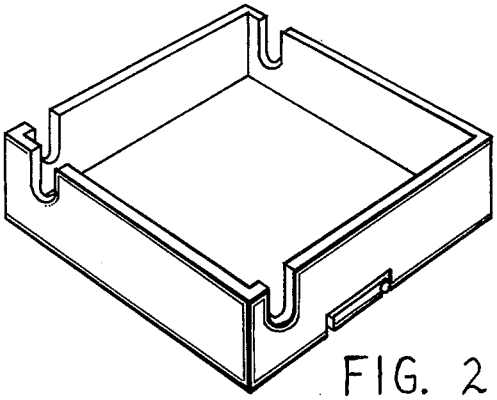
FIGS. 2–4 show views of the box with the cubes removed.
Figure 3:
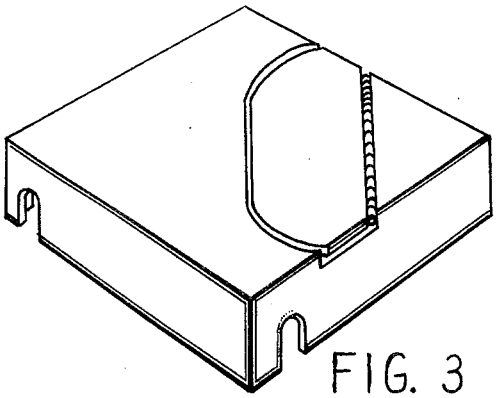
Figure 4:
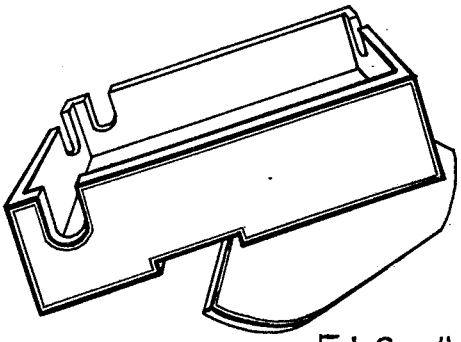

The box is designed with four finger slots through which rows of matched cubes are lifted, then rotated and moved, FIG. 2. The box has a stand that is hinged near the unslotted corner; the stand is used to raise that corner of the box higher than the other three and it is attached in such a way that when closed, the stand is flush to the bottom of the box, FIG. 3. Opposite the hinge on the stand, is an edge, flat at the center with curves at either end; the curves end at the outside edge of the box, FIG. 3. FIG. 4 is a view of the box with the stand open; the box is resting on both the flat edge of the stand (opposite the hinge), and the bottom edge of the double slotted corner. FIG. 4 also shows the curved or rocker-like edges of the stand.

Figure 5:
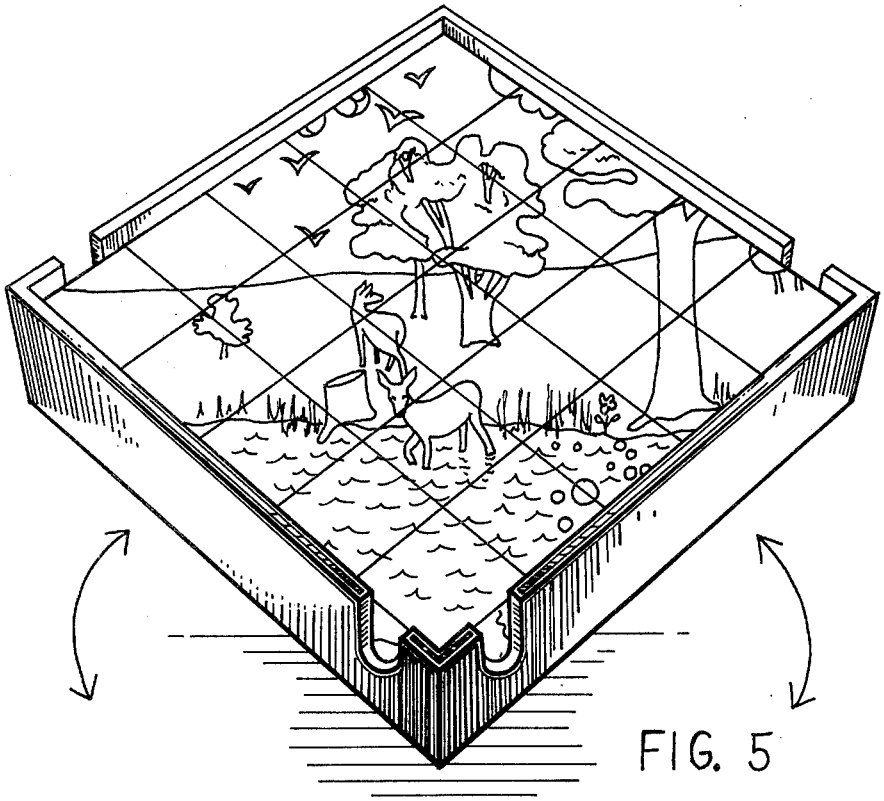
FIGS. 5–9 illustrate the movement of cubes in the box to change the pattern.

FIG. 5 is a view of the correctly assembled puzzle as it would be seen facing the player and ready for the first move. The stand of the box is open, the unslotted corner is raised and away from the player and the double slotted corner low and nearest the player. The open stand is not in view in FIG. 5 because of the tilt of the box. The curved or rocker-like edges of the stand enable the box to roll or tilt from left to right, pivoting on the bottom edge of the double slotted corner, FIG. 5, arrows. This tilt or roll increases the effect of gravity on the cubes and enables the cubes to slide easily within the box. The picture or pattern changes in the following way.

The player lifts a row of cubes out of the box by use of the finger slots. He has a choice of moving the row of cubes to the right or left of the double slotted corner.

Figure 6:
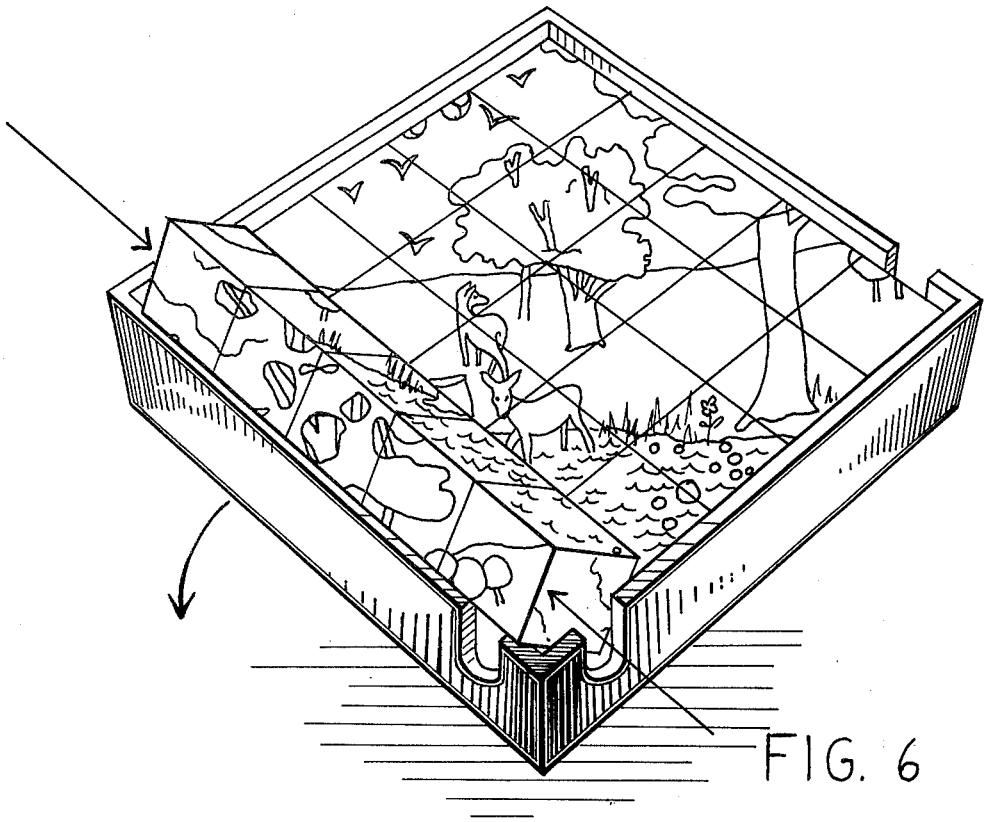
Figure 7:
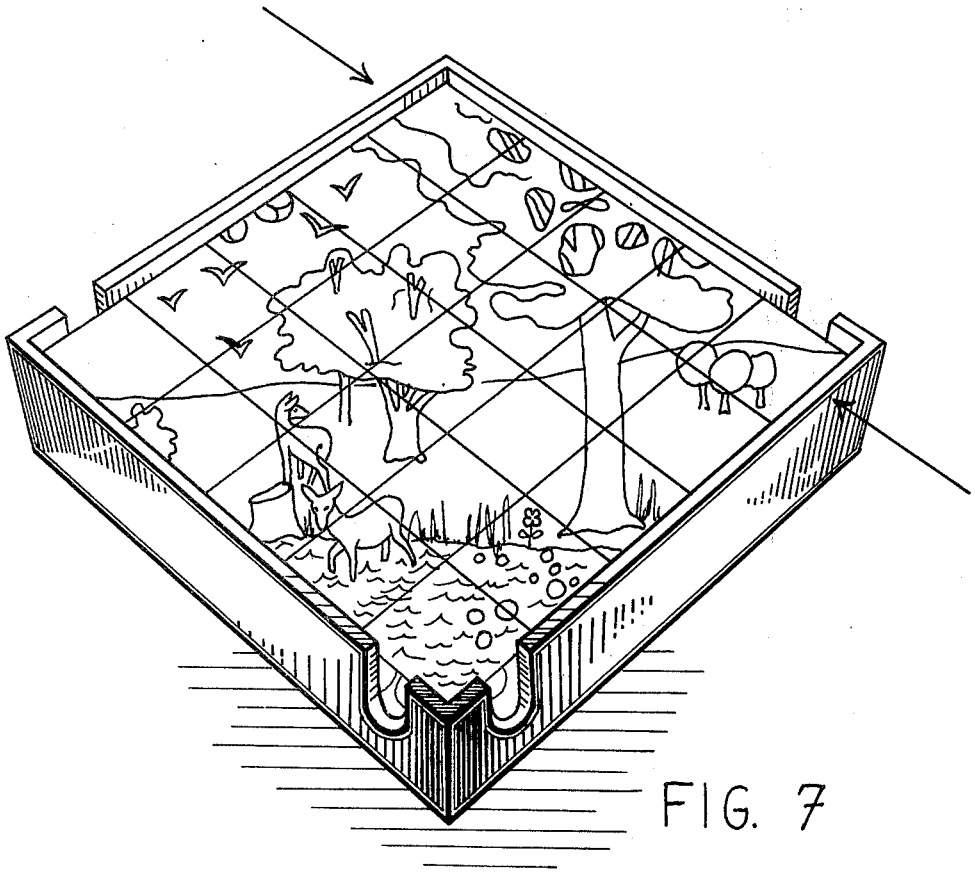

Only one move is correct, and the correct move is determined by the fact that the cubes must also match along the surface that was against the inside wall of the box, before they were lifted, FIG. 6 — straight arrows. It must be noted that because of the specific layout of the pattern of the Movie-Cube system, the pattern on one of the groups of five cubes to the right or left of the double slotted corner will always match along the inside wall of the box. If the cubes do not match along that surface, the correct move would automatically be the other row of cubes. The correct row of cubes is lifted out of the box and rotated so that the new matched surface is up. The box is then tilted or rolled, FIG. 6 — curved arrow, allowing the remaining 20 cubes to slide down filling the lower left part of the box. The lifted row of five matched cubes is placed in the upper right part of the box; thus the picture or pattern changes, FIG. 7 — arrows.

Figure 8:
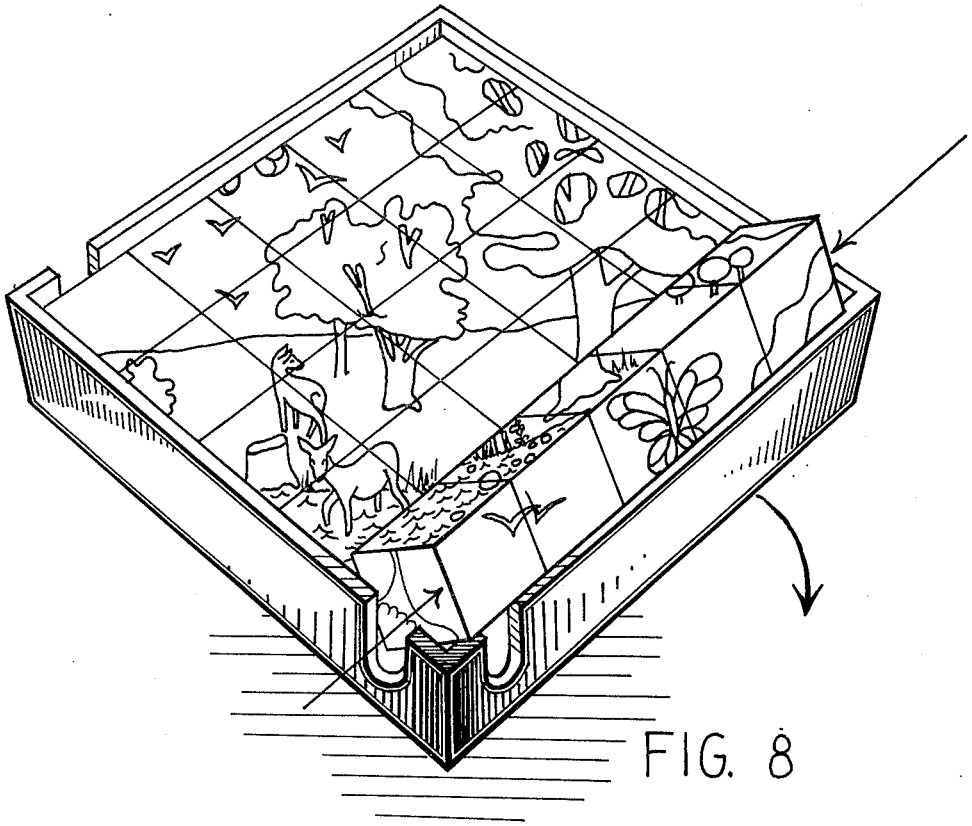
Figure 9:
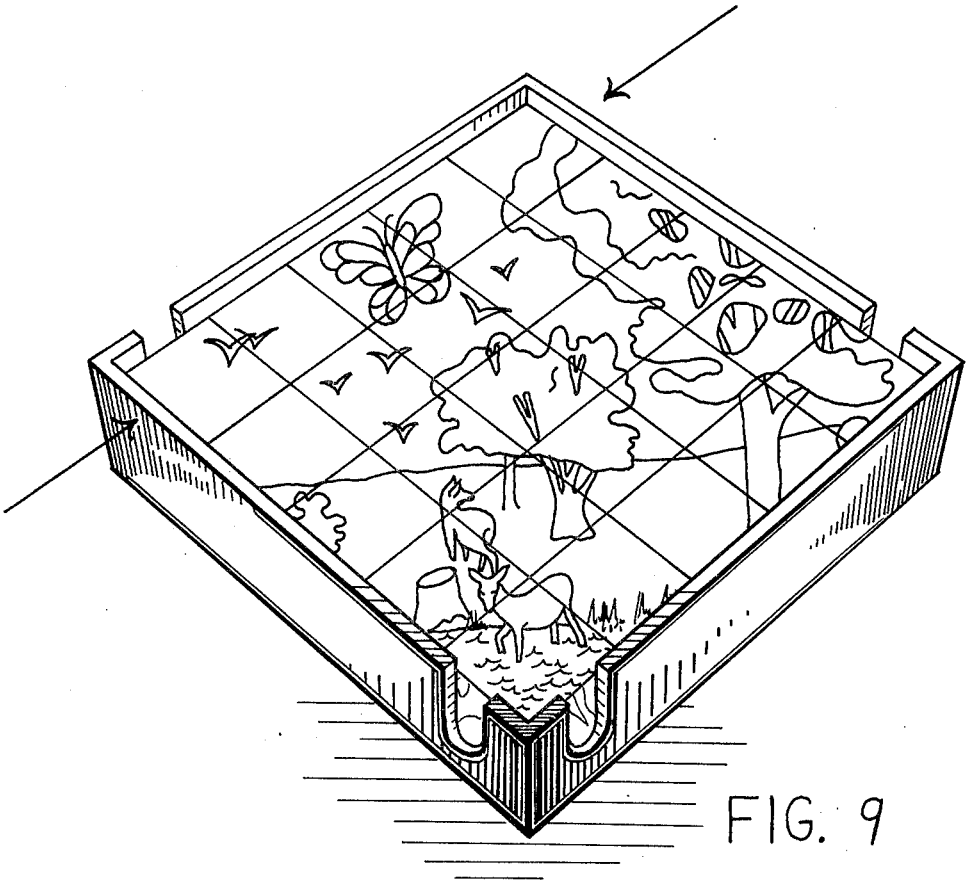

The next move would be the row of cubes to the right of the double slotted corner, FIG. 8. In FIG. 8, the matched row of cubes (straight arrows) is lifted and rotated, the box is tilted (curved arrow), and the remaining 20 cubes slide down filling the lower right part of the box. In FIG. 9, the matched row of five cubes is put in the upper left part of the box, (arrows), thus adding more to the picture or pattern. The next move would be the row of cubes to the left of the double slotted corner; the move after that would be the row on the right, and so on. The picture or pattern cannot change correctly without this balanced movement from left row to right row, left row to right row etc., and the puzzle must have an equal number of cubes per side in order for this balanced sequence of moves to work. For example, the puzzle must be five cubes or four cubes by four cubes, not five cubes by four cubes. In my example of a five cube by five cube puzzle, 30 rows of five cubes each must be moved alternately in order for the picture or pattern to change and eventually return to itself. The 30 moves are calculated as follows; six (surfaces of a cube) times five (the number of cubes per row) = 30 moves.

Figure 10:
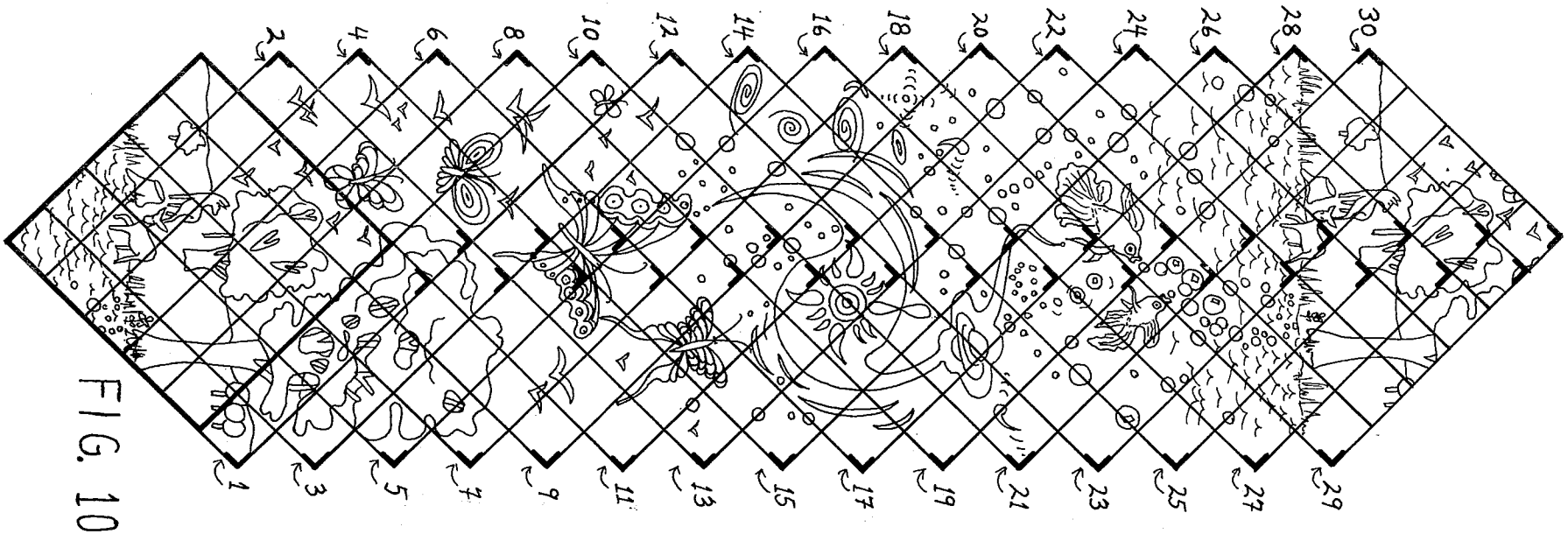

FIG. 10 represents, two-dimensionally, a layout of the pattern for the 25 cube puzzle as it would look before it is applied to the three-dimensional cubes. This 45° zig-zag layout of the pattern together with the alternating movement of rows of cubes is the basis of the Movie-Cube system. At the bottom is the 25 cube pattern of deer in a landscape, seen earlier in FIG. 5. The moves are numbered 1 through 30 next to the appropriate bracketed row of five cubes. FIG. 10 — Number 1 and its bracketed row of five cubes is the first move as seen earlier in FIGS. 6 and 7. The next move is automatically the bracketed row of five cubes marked FIG. 10 — Number 2, seen earlier in FIGS. 8 and 9. As you can see, the movement of rows of cubes is balanced, i.e., from left row to right row, left row to right row etc., and the pattern must be laid out and applied to the cubes according to this balanced 45° zig-zag sequence in order for the continuous movement of the picture or pattern to be correct and eventually return to itself. By following the entire 45° zig-zag sequence of 30 moves, we can see that the 25 cube puzzle of deer in a landscape changes and returns to itself by the time the sequence of moves reaches FIG. 10 — Number 30. All of the surfaces of all of the cubes are exposed in this 45 degree zig-zag sequence.

The purpose of FIG. 11 is to explain in numbers, rather than pictures, where each cube appears within the sequence of 30 zig-zag moves of the five cube by five cube puzzle. At the bottom of FIG. 11 is the 25 cube puzzle seen earlier at the bottom of FIG. 10, but instead of the pattern of deer in a landscape, the cubes are numbered 1 through 25. The rows of cubes are bracketed in groups of five cubes and the movements (M) are numbered M-1 through M-30 along the outside edge of the appropriate bracket. In FIG. 10 these moves are numbered 1 through 30. The first move, FIG. 11 Number M-1, involves moving and rotating cubes 21, 22, 23, 24, and 25; this bracketed row of five cubes is the same move as FIG. 10 Number 1. In the second move, FIG. 11 Number M-2, the cubes marked 20, 15, 10, 5 and 25 are moved and rotated; this move is the same as FIG. 10 Number 2,and so on.

The Movie-Cube system, in brief, is a combination of the movement and patterning of a group of three-dimensional cubes; the system is laid out on a 45° zig-zag graph which brings together a balanced number of surfaces of the cubes with an equally balanced number of moves. The result is a group fo specifically patterned three-dimensional cubes that can be arranged, and once arranged, moved to reveal a continuous picture that eventually returns to itself. The Movie-Cube system is the most important feature of the puzzle.

In FIG. 11 the individual cubes move in a 45° zig-zag sequence as can be seen by following the movements of cubes 8 and 11; these two examples are further identified by thin veritcal lines (cube 8) and horizontal lines (cube 11). This same 45 degree zig-zag sequence applies to any cube of the 25 cube puzzle and even though the movement numbers (FIG. 11 — M-1 through M-30) will vary from cube to cube, any given cube in a five cube by five cube puzzle will always be spaced 5 cubes from itself at a 45° angle on the zig-zag graph. There are six surfaces to each cube and, for example, each time cubes 8 or 11 appears in the sequence on the graph, it represents a new surface or pattern exposed on cubes 8 and 11.

In FIG. 11 the broken lines indicate the geometric progression of the total group of 25 cubes. By the time the sequence reaches the 10th move, FIG. 11 — M-10, we see that two groups of 25 new surfaces have been exposed, one group in the center; the other to the left and right. By the 20the move, FIG. 11— M-20, two more groups of 25 new surfaces of the cubes have been exposed, and by the 30th move, FIG. 11 — M-30, the full sequence is complete.

FIG. 12 represents, two-dimensionally, the shape of the 6 surfaces of cubes 8 and 11 from FIG. 11. Cube 11 is on the bottom of FIG. 12 and cube 8 is on the top. The arrows indicate the 45°zig-zag direction of each move, and the appropriate movement numbers (M), from FIG. 11, are at the edge of each surface. Each of the surfaces is also numbered 1 through 6 in order of their appearance in the sequence of moves.

The six surfaces of a cube times the number of cubes per row equals the number of moves needed to complete the full sequence of the picture or patten of a group of Movie-Cubes. The minimum number of cubes per group is four, or two cubes by two cubes, and with 6 as the common multiplier, a two cube by two cube Movie-Cube system requires 12 moves in order for the full cycle or sequence of the picture or pattern on the cubes to return to its starting point. A three cube by three cube Movie-Cube system requires 18 moves (6 × 3), a four cube by four cube system requires 24 moves (6 × 4), and so on. Once the number of moves is known, a 45° zig-zag graph can be drawn to determine the layout of an entire pattern for a group of Movie-Cubes, as well as, the pattern and location of each surface of each cube in that system.

In conclusion, Movie-Cubes is a system by which all the surfaces of a group of three-dimensional cubes are patterned in a way that when the cubes are arranged and moved correctly, they create a continuous picture or pattern that changes and eventually returns to itself.

MANUFACTURING TECHNIQUES

There are several ways that the Movie-Cube system described can be manufactured. The cubes and box can be made of wood, injection molded plastic or, on a larger scale, they can be made of metal or other suitable material. The pattern on the surface of each cube can be silk-screened, hot stamped or printed in a mechanical sequence on an assembly line, or; prepainted material such as a special paper, vinyl or the like could be applied to or laminated to plain cubes. The cubes can be made of a special thin pre-printed material, cut to either the zig-zag shapes seen in FIG. 12 or cut to the shape of a cross with tabs; these shapes would be folded to the shape of a cube, much like a cardboard box. Also, to facilitate the effect of gravity, the cubes can be hollow and have metal pellets or a metal ball inside. Should dexterity be a problem in lifting and rotating rows of cubes, thin slots could be drilled or molded through the centers of each surface of the cubes. These slots would allow a long thin flat bar to slide through the rows of cubes to facilitate lifting, rotating, and placing the cubes in the correct position in the box. The surfaces of the cube could be recessed or indented in places to add more dimension to the picture or pattern.

While the above example of the invention is for a picture puzzle, the invention has other uses.

For example the invention can be embodied in an educational device. On the cubes according to the invention are printed or painted patterns, words, numbers, colors or symbols. The purpose of this device or system is to teach or explain, through the correct arrangement and movement of the cubes, anything which can be considered a cycle or that which returns to itself. For example, the cycle could be the seasons of the year, or the cycle of a seed from its formation, to sprouting, to a period of growth, and eventually back to seed. The subject matter can vary from the simplest colors, words, patterns, numbers or symbols, aimed at a young age level, to much more complex material for the advanced learner. The number of cubes within the box can vary depending on the simplicity or complexity of the cycle.

Another embodiment of the invention is a large mechanical device the purpose of which is to convey a message or advertisement as on a large billboard or other display. The device would comprise patterned cubes according to the invention within a large square shallow box or container. The cubes would be moved by hydraulic, magnetic or other mechanical means. The movement of the cubes by mechanical arms would be coupled to a mechanical system that would roll or tilt the box enabling the large cubes to slide within the box by increasing the effect of gravity on the cubes. Also, castors or rollers could be placed in either the box or on each surface of each cube to facilitate the movement of the cubes. The surfaces of the cubes would be covered by printed or painted colors, words, symbols, patterns or numbers which would be part of the message or picture conveyed. The device would be constructed of sturdy materials capable of withstanding constant use and possible exposure to an outdoor environment.

Another embodiment is a small mechanical device the purpose of which is to convey a picture or message. The device would be used on a table, counter, or shelf in the home or school or it could be used commerically in store display. The device would comprise a square shallow box filled with patterned cubes according to the invention. The cubes would be moved by means of small mechanical arms which would be coupled to a mechanical system used to roll or tilt the specially designed box from left to right. The box has the above described rocker-like stand towards one corner used to raise the box higher at that corner than the other three. The roll or tilt of the box enables the cubes to slide within the box. The surface of the cubes would be covered by printed or painted colors, words, symbols, patterns or numbers related to the message conveyed, be it educational, commercial or decorative.

In another embodiment of the invention, the device comprises patterned cubes according to the invention which slide within a square shallow box used to tell a short story or poem. The words and pictures of the short story or poem would be presented in a way that creates the feeling that there is no beginning or end to the short story or poem, but, rather, a continuous flow of words and pictures which begins or ends anywhere within the cycle of the story or poem.

Yet another embodiment is an educatonal device made of textured, embossed or engraved interlocking cubes according to the invention which slide within a square shallow box. When the cubes are arranged, by matching textures, and moved correctly within the box, they create a continuous textured picture or pattern that changes and eventually returns to where it started. The cubes and box would be made of plastic, wood, metal or other material capable of being textured, embossed or engraved. This device would be used to teach through the sense of touch. It would be used by either a blind person or a person wearing a blindfold to expand that person's use and awareness of his sense of touch. Braille could be applied so that when the cubes are assembled and moved correctly, within the box, the textured surface could tell a short story or poem, be a simple textured journey for that person's sense of touch, or teach more complex material.

In yet another embodiment, the device comprises a square shallow box filled with transparent patterned cubes that light up by use of a gravity battery or gravity contact built within the center of each cube. The pattern on the cubes according to the invention is transparent. When the cubes are arranged and moved within the box according to the invention, they create a continuous illuminated picture or pattern that eventually returns to where it started. The surfaces of the cubes that are up or highest would light up because the gravity battery or gravity contact would automatically settle in the lowest part of a cavity in the center of each cube. Electrical contact settles within the cavity, which is wired so that the surface of the cube that is up or highest, and opposite the contact, would light up.

Having described my invention, what I claim as new, novel, non-obvious and desire to secure by Letters Patent is:

1. A graphics system comprising set of $n^2$ patterned surfaced, identically sized cubes, $n$ being an integer at least 2, the patterned surfaces of the cubes being selectable by arranging a comprehensive non-repeating continuous pattern two pattern, the size of each square corresponding to the size of a face of the cubes, the grid being in the form of $3n$ nested inverted 90°V's, a respective leg on the same side of each of the V's, excluding the apex square, being formed of $(n\text{-}1)$ of said squares and the other leg of each of the V's, excluding the apex square, being formed of $n$ of said squares, whereby the grid consists of $6n^2$ of said squares, for each of the cubes selecting a series of a respective six squares of the grid arranged on the grid in a zig-zag pattern in which said respective six squares constitute the ends and the corners of the pattern and are separated from each other in the pattern by $(n\text{-}1)$ squares, arranging the selected six squares into a continuous zig-zag array with the selected six squares in the same positions and orientations relative to each other as in said zig-zag pattern and folding said zig-zag array into a cubic configuration to form the patterned surfaces of a respective one of said patterned cubes of said set, the arrangement of squares of said grid on the set of cubes therefore imparting to the set of cubes the characteristic that the set of cubes is capable of being arranged in a square array one cube deep with a $1n$ continuous portion of the comprehensive continuous pattern being exhibited by the upward directed faces of the cubes of the array and a complete cycle of the comprehensive continuous pattern can be serially exhibited by alternatingly moving a single row of cubes from respective two adjoining edges of the array to opposite edges thereof while rotating the cubes of the row 90° in the direction in which the row is moved for a total of $6n$ such moves.

2. A graphics system according to claim 1, further comprising means for retaining said set of cubes in a square array one cube deep.

3. A graphics system according to claim 2, in which the retaining means comprises a box having a square bottom, side walls surrounding the bottom and an open top.

4. A graphics system according to claim 3, in which the box is of a depth not substantially greater than the length of an edge of one of the blocks and a respective pair of opposed finger slots is formed in each pair of opposed side walls normal to and adjacent a respective one of said edges thereby to facilitate manual moving of said rows by an operator of the system by the operator's clamping each said row between his fingers, said fingers being brought into contact with opposed ends of the row by insertion through the finger slots, and then manually performing said rotation and said movement to an opposite edge of said array.

5. A graphics system according to claim 4, in which said walls with finger slots formed therein form a corner of the box and further comprising means for elevating a corner of the box diagonally opposite said corner formed by the finger slot-containing walls thereby to facilitate gravity induced displacement of the array to fill the space vacated by the row of blocks being moved and provide a space at the opposite side of the box for filling by the moved row of blocks.

6. A graphics system according to claim 5, in which said elevating means comprises a stand and hinge means connecting the stand to the underside of the bottom of the box, said stand being pivotable about an axis formed by said hinge means between a position in which said stand is closed against the underside of the bottom of the box and a position in which said stand is projecting downwardly from the underside of the bottom of the box thereby to elevate said diagonally opposite corner.

7. A graphics system according to claim 6, comprising a recess formed in the underside of the bottom of the box for receiving said stand when said stand is closed, a face of the closed stand forming a substantially continuous planar surface with said underside of the bottom of the box.

8. Apparatus according to claim 6, in which said stand is formed as a rocker thereby to permit selective manipulation of the orientation of the box to cause gravity to favor displacement of said array away from either of said opposite sides to provide a space for filling by the row of blocks being moved to that side.

* * * * *

UNITED STATES PATENT AND TRADEMARK OFFICE

CERTIFICATE OF CORRECTION

PATENT NO. : 4021939

DATED : May 10, 1977

INVENTOR(S) : Robert Joseph May

It is certified that error appears in the above-identified patent and that said Letters Patent are hereby corrected as shown below:

line 38, change "oe" to --or--.

Column 3, line 21, change "fo" to --of--.
line 45, change "20the" to --20th--;
line 59, change "patten" to --pattern--.

Column 5, line 67, after "comprising" insert --a--.

Column 6, line 3, after "two" insert --dimensionally, superimposing a grid of squares on the two dimensional--.

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*